United States Patent [19]

Busing

[11] 4,323,244

[45] Apr. 6, 1982

[54] SOLID GEOMETRICAL PUZZLE METHOD OF ASSEMBLING MEANS

[76] Inventor: David W. Busing, 169 Mamaroneck Ave., White Plains, N.Y. 10601

[21] Appl. No.: 103,901

[22] Filed: Dec. 17, 1979

Related U.S. Application Data

[63] Continuation-in-part of Ser. No. 947,465, Dec. 2, 1978, abandoned.

[51] Int. Cl.[3] ..... A63F 9/08

[52] U.S. Cl. ..... 273/155; 46/1 R; 156/73.1

[58] Field of Search ..... 273/155; 46/1 R, 1 L; 156/73.1; 16/DIG. 13

[56] References Cited

U.S. PATENT DOCUMENTS

| | | | |
|---|---|---|---|
| 2,992,829 | 7/1961 | Hopkins | 273/155 |
| 3,746,345 | 7/1973 | Palazzolo | 273/155 |
| 4,142,321 | 3/1979 | Coppa | 273/155 X |

FOREIGN PATENT DOCUMENTS

| | | | |
|---|---|---|---|
| 1197895 | 7/1970 | United Kingdom | 273/155 |

*Primary Examiner*—Anton O. Oechsle

*Attorney, Agent, or Firm*—Spellman, Joel & Pelton

[57] ABSTRACT

A solid geometrical puzzle comprises a plurality of basic components each of which is hinged along two edges to neighboring components. A typical basic component comprises a solid element that is triangular in cross section, said triangle being a right angle isosceles triangle. The solid element has three four-sided faces, a lower face, an upper face extending 90° to the lower face and a face joining the free ends of the upper and lower faces. The end portions of the element are triangles. The assembly may be folded along the hinge lines of a particular type to form many regular and irregular geometric shapes such as sawtooth configurations, parallelpipeds etc. The arrangement is intriguing and interesting to work with as a form of amusement and special effects may be obtained by printing designs on the faces.

6 Claims, 24 Drawing Figures

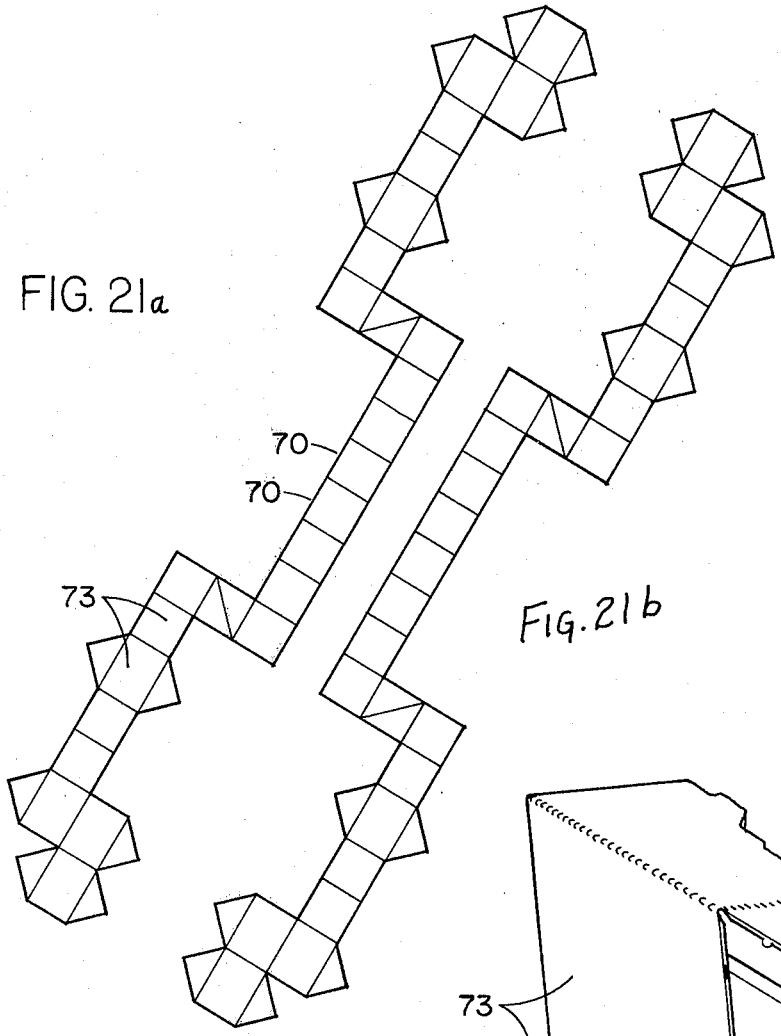
FIG. 21a
FIG. 21b
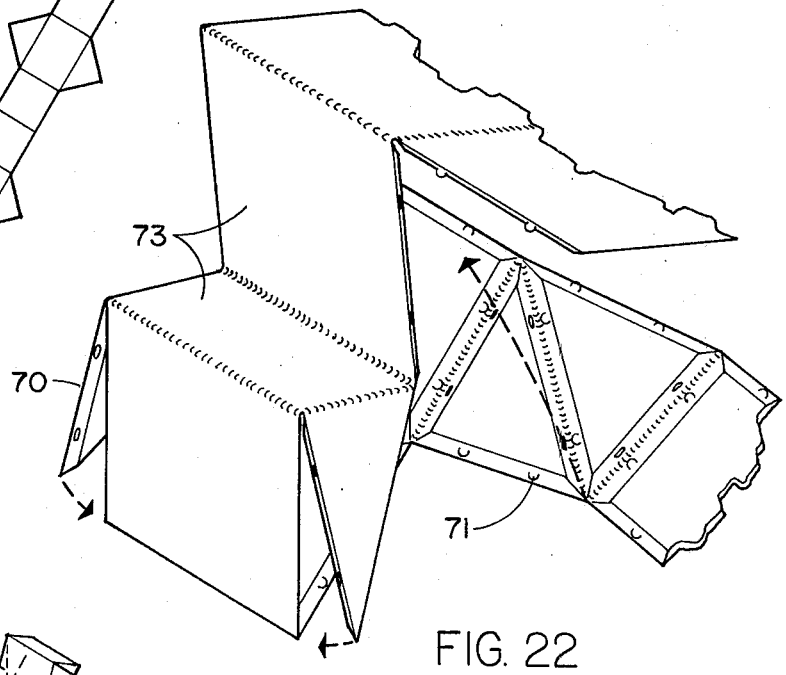
FIG. 22
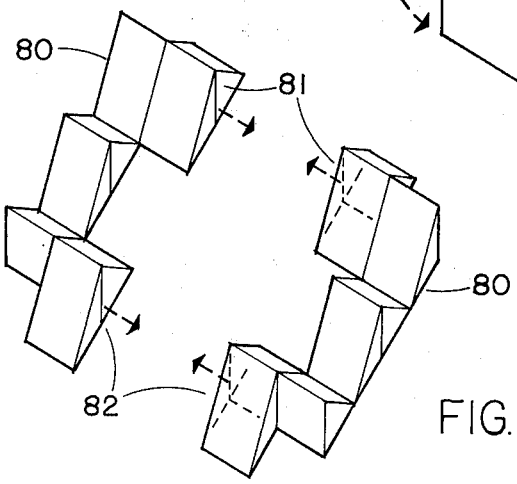
FIG. 23

SOLID GEOMETRICAL PUZZLE METHOD OF ASSEMBLING MEANS

BACKGROUND OF THE INVENTION

This invention is a continuation-in-part of my present pending application of the same title, U.S. Ser. No. 947,465, filed Dec. 2, 1979, and now abandoned, relating to puzzle devices and particularly to a new and improved geometrical puzzle.

The prior art discloses various puzzle arrangements using geometrical forms. In particular, U.S. Pat. No. 3,201,894 to R. D. Resch discloses a geometrical device with components such as triangular shaped blocks having adjacent parallel hinged edges. The hinged components are arranged in a different overall manner from the present invention to produce various geometrical designs.

Of particular interest is U.S. Pat. No. 2,992,829 to C. L. Hopkins which relates to polymorphis geometrical devices. This patent, however, does not disclose the hinging or the assembling techniques of the present invention.

U.S. Pat. No. 3,773,329 to M. Secter is of general interest showing six elongated right-parallelepipeds which can form different geometrical arrangements including a single larger right parallelepiped configuration. Also of general interest is U.S. Pat. No. 847,545 to B. G. Braine which discloses a puzzle of generally square configuration which comprises a plurality of foldable triangular portions which may be shaped to form a desired arrangement.

In U.S. Pat. No. 1,547,967 to W. Shilhan, a figure toy is disclosed which is sold in the form of a blank having a plurality of fold lines thereon for assembly by the purchaser. Figures may be imprinted upon the blank so as to provide various figure arrangements when the device is shaped into a particular arrangement.

Finally U.S. Pat. No. 1,944,696 to E. Reichl discloses a folding panel device utilizing rectangular panels joined alone and U.S. Pat. No. 3,595,396 to B. J. Thomson is restricted to a particular hinging arrangement.

While the prior art discloses a number of geometrical puzzle arrangement which are old, none of the references disclose the precise hinge arrangement of the present invention in cooperation with particular shaped components which may be utilized to form various geometrical shapes. In contrast to the prior art, the present invention provides a considerable latitude in coming up with new and interesting shapes and offers a distinct challenge in attaining certain specified configurations.

SUMMARY OF THE INVENTION

The present invention relates to a new design arrangement which comprises a geometrical puzzle. The arrangement includes a plurality of basic components, preferably sixteen in number, each of which is hinged along two edges to neighboring components. A typical basic component comprises an element that is triangular in cross section, said triangle being a right angle isosceles triangle. The element has three four-sided faces, a lower face, an upper face extending 90° to the lower face and a face joining the free ends of the upper and lower faces. The assembly may be folded along the hinge lines to form many regular and irregular geometric shapes and indeed turned "inside out". The hinges are produced by the application of preprinted polypropylene surface films to the component faces and subsequent cutting and assembly of the components. Alternatively, the faces of the puzzle may be formed from a shaped flat strip to which a film is applied and then the strip is folded and assembled together.

Accordingly, an object to this invention is to provide a new and improed geometrical puzzle device.

Another object to this invention is to form a new and improved geometrical puzzle device comprising a plurality of solid hinged components which may be assembled to form predetermined shapes.

A more specific object of this invention is to provide a new and improved puzzle comprising a plurality of basic components which are triangular in cross-section and hinged in a unique manner along two edges which may be assembled to form predetermined configurations.

BRIEF DESCRIPTION OF THE DRAWINGS

Other objects and advantages of the present invention may be seen from the following description when viewed in conjunction with the accompanying drawings wherein:

FIGS. 21*a* and 21*b* disclose the topology of the puzzle which is formed in two identical symmetrical sections, FIG. 22 discloses the folding of the component basis of FIG. 21 to form the puzzle components, FIG. 23 discloses the joining of the two halves of the puzzles to form a complete arrangement.

DETAILED DESCRIPTION OF THE INVENTION

Figure 1:
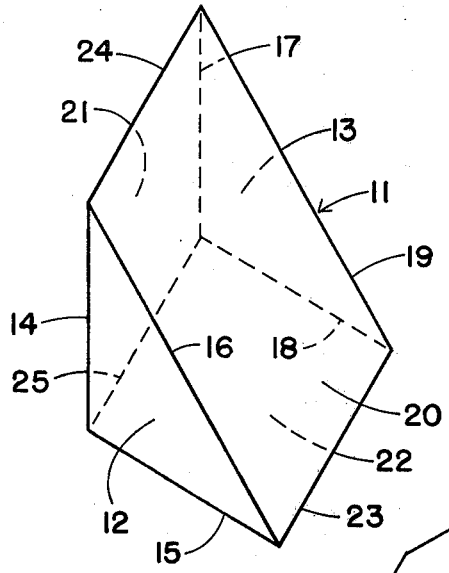
FIG. 1 is a perspective view showing a basic component of the puzzle assembly.

Referring now to the drawings and in particular FIG. 1, the present invention relates to a unique design arrangement or puzzle 10. The puzzle 10 is formed of a number of basic components 11, each comprising a solid element having triangular side faces 12 and 13 formed by sides 14, 15, and 16 in the case face 12 and 17, 18, and 19 in the case of triangular face 13. The triangular faces 12 and 13 are preferably right angle isosceles triangles with the right angle located between the sides 14 and 15 and 17–18 respectively.

The basic component 11 also includes three four sided faces 20, 21, and 22 joining the triangular faces 12 and 13 together in a solid arrangement. The faces 20 and 22 are joined along edge 23 which is equal in length to the triangle sides 14, 15, 17 and 18. Face 21 is joined to face 22 along edge 25 and face 21 is joined to face 20 along edge 24. The edges 23, 24 and 25 are equal in dimension so that all edges 23, 24 and 25 and all sides 14, 15, 17 and 18 are equal.

Figure 2:
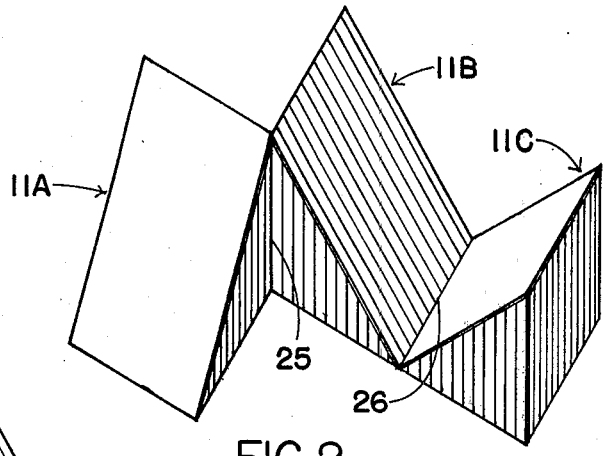
FIG. 2 shows a component hinged along two sides to adjoining components in a hypothetical hinging arrangement.

Each basic component 11*a*–11*p*, is hinged along two edges to adjacent components. By way of illustration, in FIG. 2, the component 11*b* is hinged along edges 25 and 26 to the adjacent components 11*a* and 11*c*. The particular sides or edges which are hinged will vary depending upon the position of the component in the puzzle arrangement 10.

Figure 3:
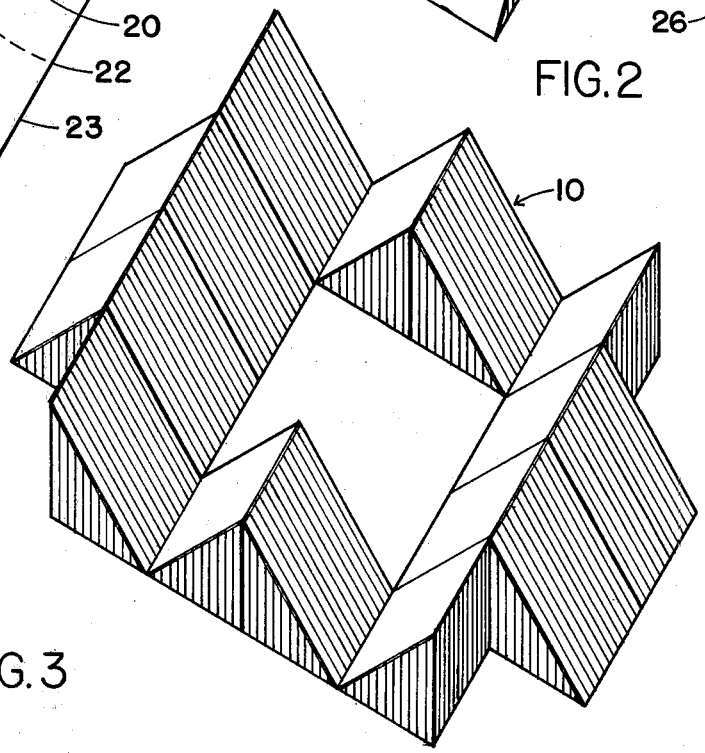
FIG. 3 shows an assembly of a typical arrangement of 16 basic components.
Figure 4:
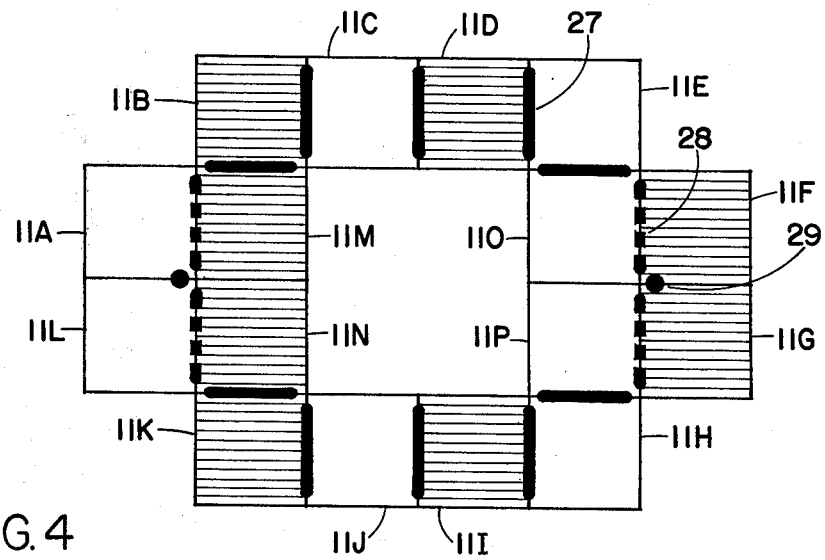
FIG. 4 shows a plan view of the assembly of FIG. 3 and locates all 16 hinge points.

FIG. 3 shows a basic assembly of 16 components which comprise the puzzle 10. The 16 hinges of the puzzle 10 are illustrated in FIG. 4 wherein a solid bar 27 (ten shown) represents a hinge visible in the particular view while a dashed line 28 (four shown) represents a hinge not visible in FIG. 4 (six in number). The circles 29 (two shown) represent vertical hinges in this plan view.

Figure 5:
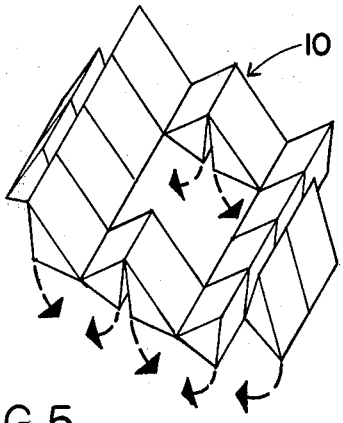
FIG. 5 shows how the assembly in FIG. 3 can be folded on the hinge lines to form the assembly shown in FIG. 6.
Figure 6:
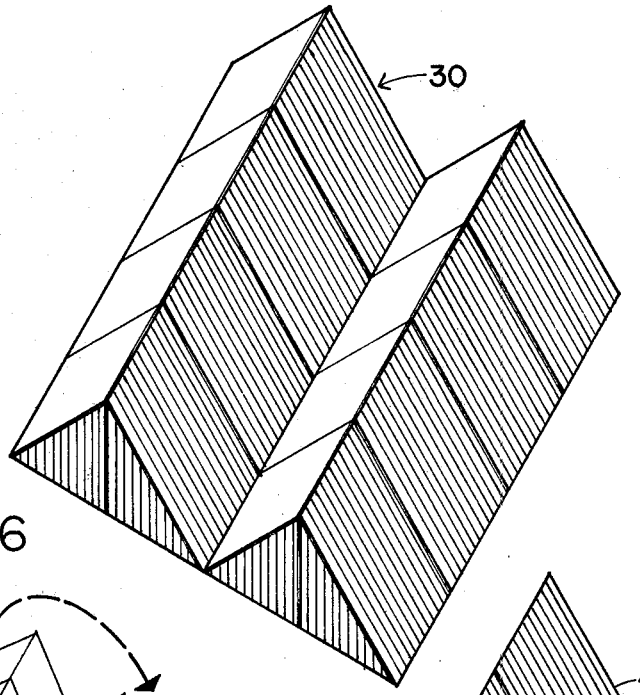
FIG. 6 is a typical saw-tooth assembly formed as indicated in FIG. 5.

The perspective view of FIG. 5 illustrates how the puzzle 10 of FIG. 3 may be folded along the hinge lines to form the saw-tooth configuration 30 of FIG. 3. The components 11*a*–*11p* are moved in the direction indicated by the arrows while each component remains hinged along two of its edges to two adjacent components.

Figure 7:
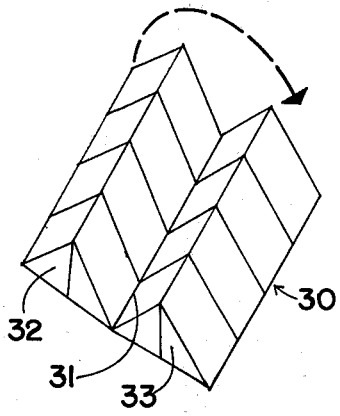
FIG. 7 shows how the assembly in FIG. 6 can be folded on hinge lines to form the assembly shown in FIG. 8.
Figure 8:
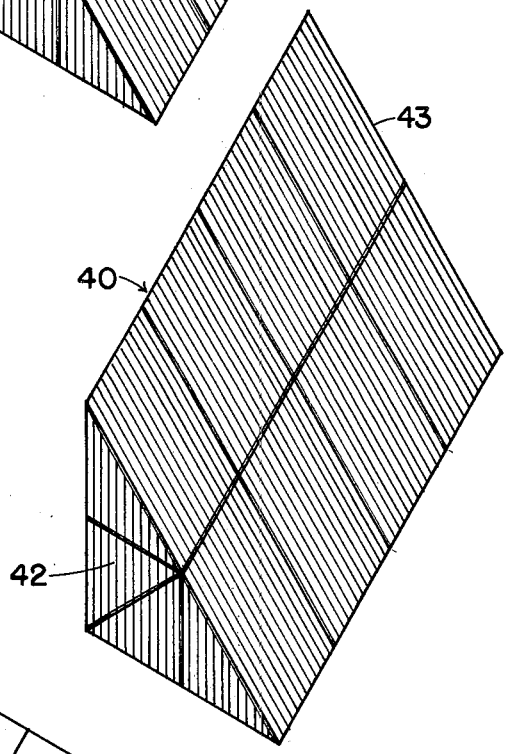
FIG. 8 is a typical assembly formed as shown in FIG. 7.
Figure 9:
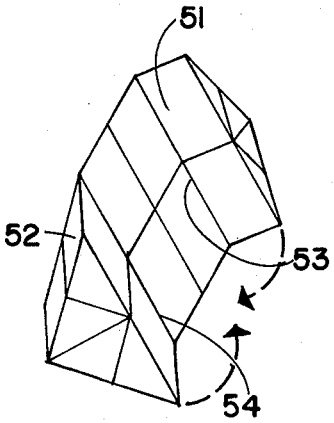
FIG. 9 illustrates how the assembly in FIG. 8 can be folded on the hinge lines to form the cube assembly shown in FIG. 10.

As shown in FIG. 7 one half 32 of the saw-tooth configuration 30 may be pivoted along line 31 on to the other wall 32 to form the triangular arrangement 40 of FIG. 8. The end faces 42 and 43 comprise four mating components 11 while the overall length of the arrangement 40 is four components long.

Figure 10:
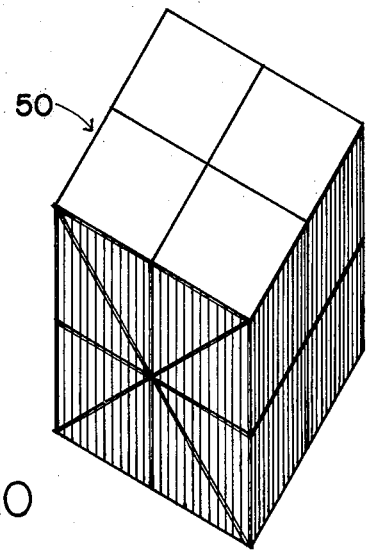
FIG. 10 is a typical cube assembly which is formed by the method illustrated in FIG. 9.

The triangular arrangement 40 of FIG. 8 may be changed into the cube 50 of FIG. 10 by pivoting the end groupings 51 and 52 along lines 53 and 54. Thus, it may be seen that many regular and irregular interesting shapes even beyond those illustrated may be formed by pivoting the basic components 11*a*–11*p* along the hinge points.

In the preferred embodiment shown in the drawings, the puzzle comprises 16 basic components but other numbers could be used depending upon the geometrical configurations which are desired. Also while solid components are preferred for handling, hollow components may also be employed under the teachings of this invention.

Figure 11:
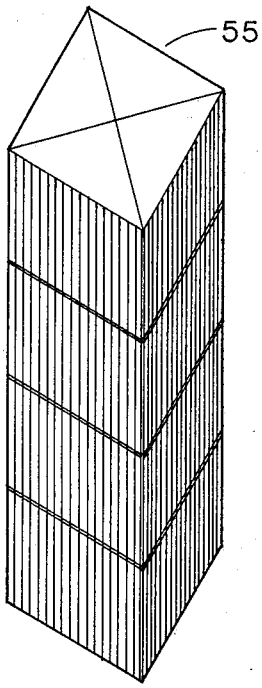
FIG. 11 is a typical elongated solid configuration which may be formed from the puzzle.
Figure 12:
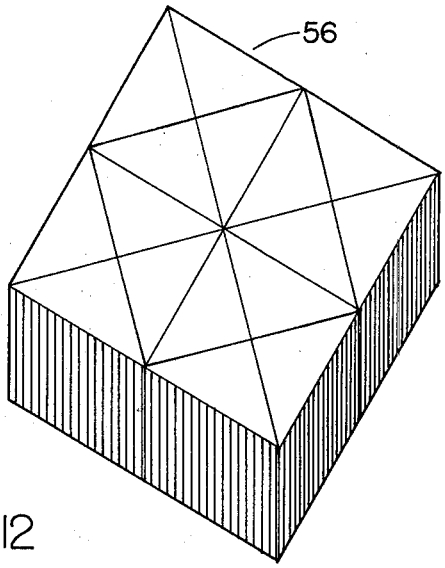
FIG. 12 is a flat solid configuration which may be formed from the puzzle.

The puzzle 10 may be manipulated into any one of three rectangular solids, a cube 50, (FIG. 10), an elongated solid 55, (FIG. 11) or a flat solid 56 (FIG. 12). This feature permits the puzzle to be packaged in several different shapes and also several different graphic forms, for example, an apple, a banana, or a pie with no change in basic geometry. An added highly attractive feature is that all the outside surfaces of the cube 50 FIG. 10) become inside surfaces of the elongated solid 55 (FIG. 11) permitting the puzzle to be "turned inside out" by manipulation. Thus, the exterior of an apple may be depicted in graphic form in one shape and the interior of the apple depicted in graphic form when the puzzle 10 is manipulated into a second shape.

Figure 13:
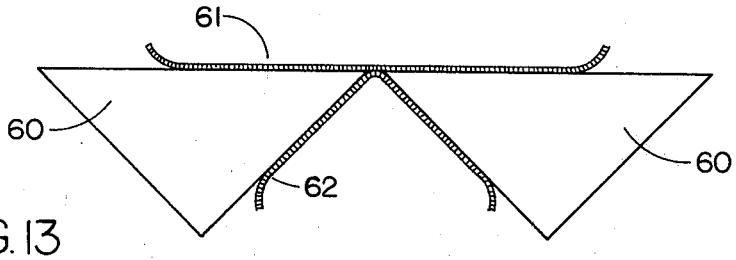
FIG. 13 shows the application of preprinted polypropylene films to form the hinging system, FIG. 14 discloses the positioning of the components in a positioning jig applying preprinted film to the surface, FIG. 15 discloses the cutting of various connections where hinges are not required after application of the film, FIG. 16, 17, 18 and 19 disclose the various assembly operations, FIG. 20 discloses a second embodiment to the invention wherein the components are assembled as a single flat surface over which a preprinted surface film is applied to form the hinges.

The basic hinging system is formed by the application of preprinted polypropylene surface films 61 and 62 to the faces of the basic components 60 as shown in FIG. 13, by means of adhesive or ultrasonic welding. This technique provides flexible, durable hinges and complete graphic treatment of the puzzle at the same time.

Figure 14:
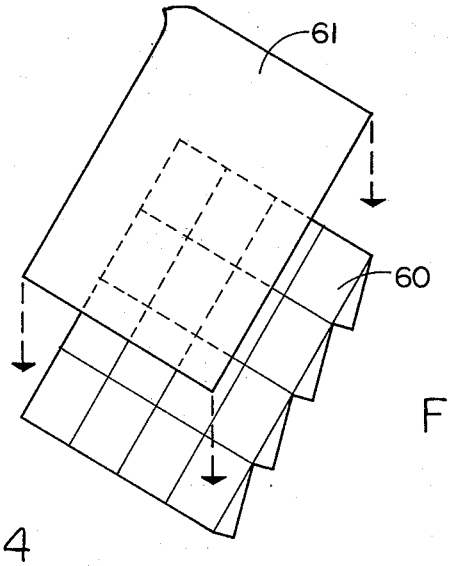
Figure 15:
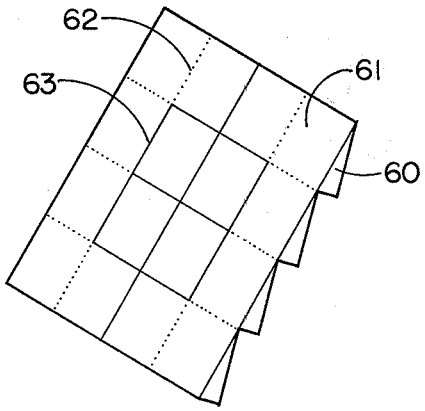
Figure 16:
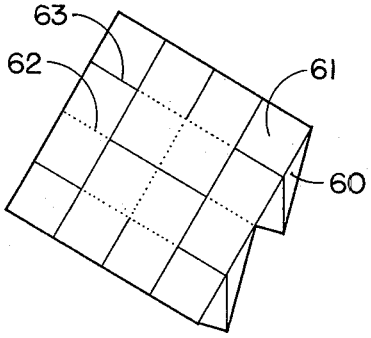
Figure 17:
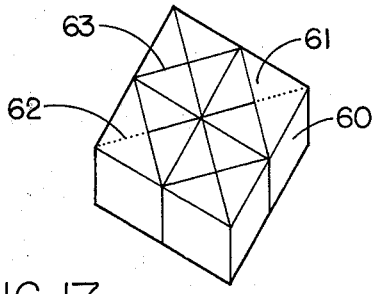
Figure 18:
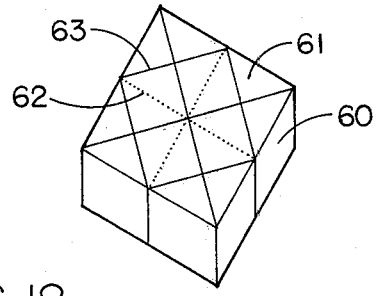
Figure 19:
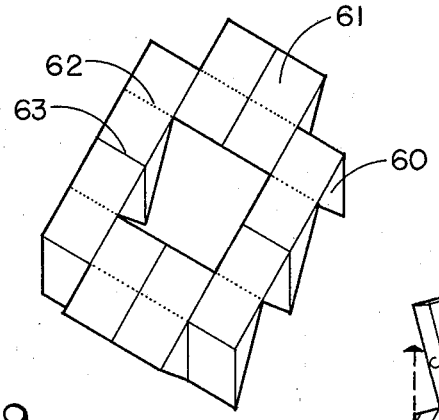
Figure 20:
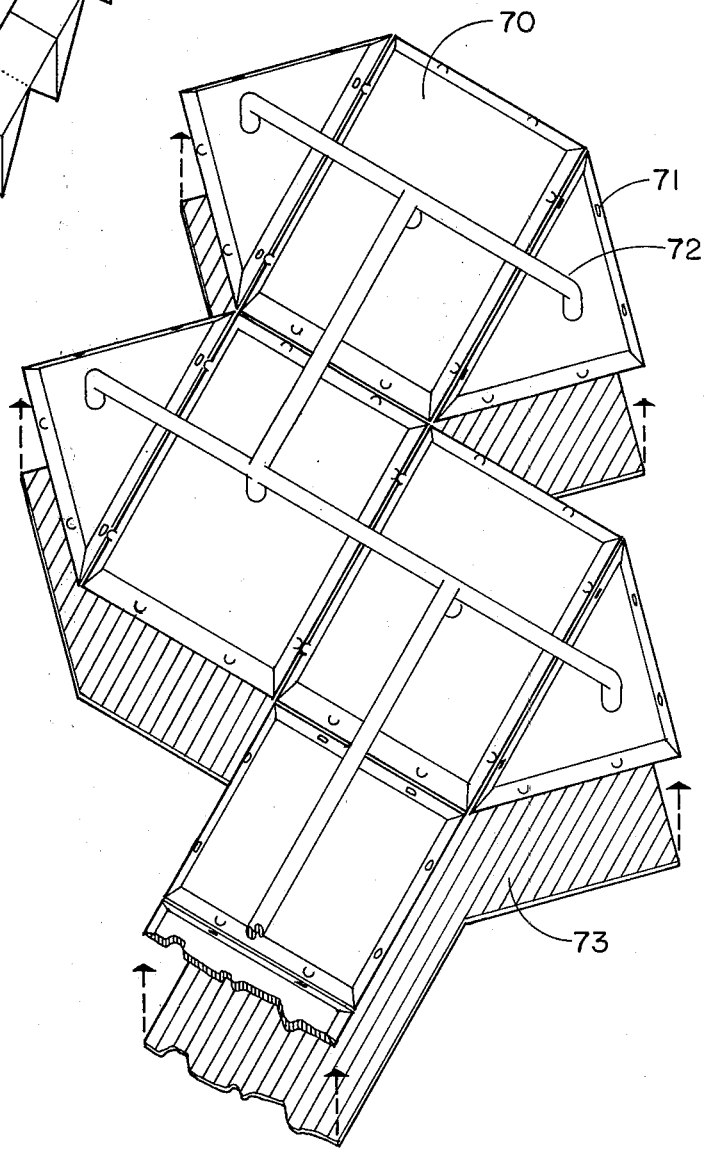

To assemble the puzzle 10, in one embodiment the components 60 (FIG. 14) are placed in a positioning jig and the preprinted film 60, 61 is applied to the surface. The first jig position is shown in FIG. 15. Subsequent to the application of the film 61 on FIG. 15 to the components 60, some connections 63 are cut where hinges are not required and some connections 62 are left uncut where hinges are required. After each jig assembly, the puzzle 10 is manipulated to fit the next jig assembly. All jig assembly positions and operations are shown in FIGS. 15–19. Upon the completion of the five operations, the puzzle 10 is complete and may be manipulated into desired shape for packaging.

A secondary assembly method shown in FIGS. 20–23 comprises forming all the faces 70 of the puzzle components as one flat surface and applying a preprinted surface film 73 to form the hinges. The edges of the faces are beveled and keyed 71 to permit alignment when snapping or gluing the edges together. A continuous sprue 72 may be left in place to position all faces for film surfacing. The sprue 72 is removed prior to assembly.

The topology of the puzzle is such that all component faces 70 may be formed in two identical, symmetrical pieces 74 as shown in FIG. 21 and both faces of all but two hinges may be formed by the application of one surface film 73. Subsequent to film surfacing and sprue removal, the flat component faces 70 are folded together 75 (FIG. 22) and snapped or glued together along the keyed, beveled edges 71. In this manner, two halves 80 shown in FIG. 23 of the puzzle 10 are formed complete with all graphics and double film hinges. The two halves 80 are joined along the two remaining hinge lines 81 and 82, FIG. 22, with film tape to form the completed puzzle which may be manipulated into any shape desired for packaging.

It is to be understood that the above-described arrangements are merely illustrative examples of the application. Numerous other arrangements may be readily devised by those skilled in the art which will embody the principles of the invention and fall within the spirit and scope thereof.

I claim:

1. The method of assembling a solid geometrical puzzle comprising the steps of:

providing a puzzle surface of separate suitable configurations comprising a plurality of puzzle components and placing said puzzle components in a positioning jig, applying a preprinted film to said surface to form hinges in predetermined locations between said components and specific graphic representations on the surface of said components, and cutting the connection between particular components where hinges are not required and removing said puzzle from the jig in an assembled condition.

2. The method of assembling a solid geometrical puzzle in accordance with claim 1 wherein:

the surface film is applied to the puzzle surface by ultrasonic welding.

3. The method of assembling a solid geometrical puzzle comprising a plurality of basic components each of said components being hinged to adjacent components along two edges thereof and comprising triangular end portions, and a plurality of four-sided faces joining the corresponding edges of the triangular portions comprising the steps of:

forming all of the faces of the puzzle components on two mirror image flat surfaces with the edges thereof beveled and keyed, applying a preprinted surface film to the flat surfaces at particular locations to form the hinges thereof, attaching the edges together in a predetermined manner to form the puzzle components, and, joining the two mirror images together after formation of the components to form a puzzle assembly.

4. A solid geometrical puzzle comprising:

sixteen basic components, each having two triangular faces and three rectangular faces and hinged along two edges to adjacent components to form a continuous, closed chain of components in a configuration as illustrated in FIGS. 3 and 4 and wherein the rectangular faces comprise a square lower face, a square rear face at 90° to the lower face and an elongated rectangular face joining the free edges of the lower and rear face and the triangular faces comprise end isosceles triangles joining the free edges of the square and rectangular faces, said component size and hinging being such that the components may be folded to form a cube, an elongated rectangular solid, a flat rectangular solid and numerous irregular solids and wherein the components may be folded so that normally outside faces of the cube configuration may be totally concealed internally by folding to another rectangular solid form.

5. A solid geometrical puzzle in accordance with claim 4 further including:

a preprinted film on the surface of said components and extending between said components in particular locations to form a hinge along two edges to adjacent components.

6. A solid geometrical puzzle in accordance with claim 4 wherein:

the faces of each component are beveled and keyed along the edges thereof to permit interlocking assembly into a separate solid member having two triangular faces and three rectangular faces, and, further including a preprinted surface film applied to the component surfaces at predetermined locations to form hinges along two edges to adjacent components.

* * * * *